US006564741B2

(12) United States Patent
Nelson

(10) Patent No.: US 6,564,741 B2
(45) Date of Patent: May 20, 2003

(54) TELESCOPING SPAR PLATFORM AND METHOD OF USING SAME

(75) Inventor: Carl V. Nelson, Rockville, MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 10/155,199

(22) Filed: May 24, 2002

(65) Prior Publication Data

US 2002/0178989 A1 Dec. 5, 2002

Related U.S. Application Data

(60) Provisional application No. 60/295,202, filed on Jun. 1, 2001.

(51) Int. Cl.[7] ..... B63B 35/44; E02D 25/00

(52) U.S. Cl. ..... 114/264; 405/205

(58) Field of Search ..... 114/121, 124, 114/125, 264, 265, 266; 405/195.1, 196, 197, 198, 200, 205, 206

(56) References Cited

U.S. PATENT DOCUMENTS

| | | | | |
|---|---|---|---|---|
| 3,161,492 A | | 12/1964 | Keith et al. | |
| 3,273,526 A | * | 9/1966 | Glosten | 114/265 |
| 3,572,041 A | | 3/1971 | Graaf | |
| 3,837,309 A | | 9/1974 | Biewer | |
| 4,112,863 A | * | 9/1978 | Nelson | 114/264 |
| 4,117,691 A | * | 10/1978 | Spray | 405/205 |
| 4,167,147 A | * | 9/1979 | Bergman | 114/122 |
| 4,702,321 A | | 10/1987 | Horton | |
| 4,869,192 A | | 9/1989 | Pawolski | |
| 4,949,643 A | | 8/1990 | Bowersett | |
| 4,962,798 A | | 10/1990 | Ferraro et al. | |
| 5,348,501 A | | 9/1994 | Brown | |
| 5,558,467 A | * | 9/1996 | Horton | 405/195.1 |
| 5,706,897 A | * | 1/1998 | Horton, III | 166/359 |
| 5,803,668 A | * | 9/1998 | Seki et al. | 405/204 |
| 6,012,873 A | | 1/2000 | Copple et al. | |
| 6,196,768 B1 | | 3/2001 | Allen et al. | |
| 6,210,075 B1 | * | 4/2001 | Korloo | 405/206 |
| 6,230,645 B1 | | 5/2001 | Chow | |
| 6,374,764 B1 | * | 4/2002 | Davenport et al. | 114/265 |

FOREIGN PATENT DOCUMENTS

GB 2041836 9/1980

OTHER PUBLICATIONS

A Low–Cost, Expendable, Helicopter–Deployed Buoy for Ocean Surface Meteorological Measurements, Carl V. Nelson vol. 13, No. 3, Jul. 1988, Reprited IEEE Journal of Oceanic Engineering; Expendable Meterological Buoy System for High Sea States, C.V. Nelson and J.B. Allison 1992, MTS Conference.

An Aircraft Deployed Buoy for Ocean Surface Meteorological Measurements, C.V. Nelson and R.F. Gasparovic 1979 IEEE Journal, pp. 196–199.

A Low–Cost, Expendable, Helicopter–Deployed Buoy for Ocean Surface Meteorological Measurements, C.V. Nelson, 1987 IEEE Journal, pp. 241–243.

* cited by examiner

*Primary Examiner*—S. Joseph Morano
*Assistant Examiner*—Andrew Wright
(74) *Attorney, Agent, or Firm*—Ernest R. Graf

(57) ABSTRACT

A telescoping spar structure designed to be scalable for use with very large floating platforms to relatively small floating platforms includes a platform/hull for supporting a payload; a telescoping spar attached to the platform/hull that includes several interlocking tubes extending from a shallow end to a deep end of the spar, the tubes configured to telescope in and out of adjacent tubes such that the tubes are nestable together in a stowed configuration; a buoyancy chamber attached to the spar between shallow and deep ends of the spar; and, a damping chamber attached to the spar between the buoyancy chamber and the deep end of the spar, the damping chamber including: a first compartment for entraining a volume of water, a second compartment for enclosing deployment ballast, and a release mechanism for jettisoning the deployment ballast from the second compartment after the spar structure is deployed, enabling the platform to rise to an operational height relative to the waterline.

5 Claims, 4 Drawing Sheets

TELESCOPING SPAR PLATFORM AND METHOD OF USING SAME

CROSS-REFERENCE TO RELATED APPLICATION

This application claims the benefit of the co-pending U.S. Provisional Application No. 60/295,202, filed on Jun. 1, 2001.

BACKGROUND OF THE INVENTION

1. Field of the Invention

The present invention relates to buoys, large floating ocean platforms, and other smaller-scale floating platforms used to support various types of instrumentation and equipment.

2. Description of the Related Art

A need for stable platforms at sea is well established in the oceanographic research and energy production communities. However the types of platforms and the platform design options available to these communities are limited. For example, the commercial platforms available to oceanographers are generally large spar buoys that weigh thousands of kilograms, are on the order of 20 m long, and are very difficult to deploy and recover from conventional ships. Smaller buoys are available, however the smaller buoys generally have very limited stability and mast height, thus restricting the type of scientific instrumentation that can be effectively deployed on the buoys. Prior art patents related to small scale buoys include, for example, U.S. Pat. No. 4,949,643 to Bowersett et al. that discloses an anti-tilt buoy mooring system for use in oceanographic and military applications. The '643 patent demonstrates the need for stabilizing buoys and is directed to stabilizing forces from mooring lines attached at the center of buoyancy of a standard, caisson type buoy. U.S. Pat. No. 5,348,501 to Brown discloses a compact retrievable marker buoy for marking underwater locations for recreational, scientific and other purposes. U.S. Pat. No. 4,962,798 to Ferraro et al. discloses a buoy deployment system for storing and deploying compact sonobuoys from an aircraft. The '798 patent illustrates the need for compact buoys capable of housing sophisticated scientific instrumentation.

For large energy production platforms, e.g., oil platforms, choices are typically limited to seafloor mounted, shallow-water jack-up towers, or floating barge or large spar exploration/production platforms. In deep-water offshore locations, it becomes impractical to establish seafloor-based platforms as a means to support an exploration/production facility above the water. Floating barge type platforms, however, have difficulty operating in a variety of sea-states and currents, while simultaneously maintaining contact with subsurface oil production equipment. Alternatively, production facilities have been designed for positioning directly on the ocean floor. Many of the facility designs in this category, however, are complex and difficult to construct and maintain. Spar-type platforms are typically very large (e.g., hundreds of thousand of tons and 100's of feet high), need to be fabricated in specially designed docks, require extreme measures to tow them into place, and are very expensive to construct (many such platforms cost more than $1 billion). The use of such large and expensive spar platforms is thus confined to applications that have a very high return on investment.

U.S. Pat. No. 3,572,041 to Graaf describes details of an oil rig production platform according to the prior art, including a massive spar section of unitary construction. U.S. Pat. No. 4,702,321 to Horton illustrates a spar structure comprising an elongated cylindrical caisson having a length over 200 m, the caisson being again of prefabricated unitary construction that must be towed to a work site.

Other designs exist concerning stabilizing large oil platforms in ultra deep water (over 600 m deep) where conventional catenary mooring lines become impractical. U.S. Pat. No. 6,012,873 to Copple et al. discloses a buoyant spar platform with a retractable gravity base. The gravity base is tethered with pre-tensioned cables to the buoyant spar structure and is designed to minimize the platform's response to excitation loads. In this design the buoyant spar structure is also a large prefabricated unitary structure.

The above-mentioned patents show a market need for stable, sea-going platforms. Further, there is a need for more compact platforms, regardless of scale, that would reduce the costs of transporting the platforms to and from a work site, and also reduce the costs of deploying and recovering the platforms at a work site.

SUMMARY OF THE INVENTION

The present invention is directed to an improved, highly stable, sea-going platform. An object of the present invention is to provide a platform that is compact in a stowed configuration for ease of transport, and that extends upon deployment to a length that increases the platform's deployed stability. Another object of the present invention is to provide a platform that is easily deployed and recovered. Yet another object of the present invention is to provide a platform design that is highly scalable, from large ocean going platforms used for energy production, to small lake-based platforms used to support small-scale instrumentation.

According to the present invention, a telescoping spar structure includes a platform/hull for supporting a payload; a telescoping spar attached to the platform/hull that includes several interlocking tubes extending from a shallow end to a deep end of the spar, the tubes configured to telescope in and out of adjacent tubes such that the tubes are nestable together in a stowed configuration; a buoyancy chamber attached to the spar between shallow and deep ends of the spar; and, a damping chamber attached to the spar between the buoyancy chamber and the deep end of the spar, the damping chamber including: a first compartment for entraining a volume of water, a second compartment for enclosing deployment ballast, and a release mechanism for jettisoning the deployment ballast from the second compartment after the spar structure is deployed.

DESCRIPTION OF THE PREFERRED EMBODIMENTS

Figure 1:
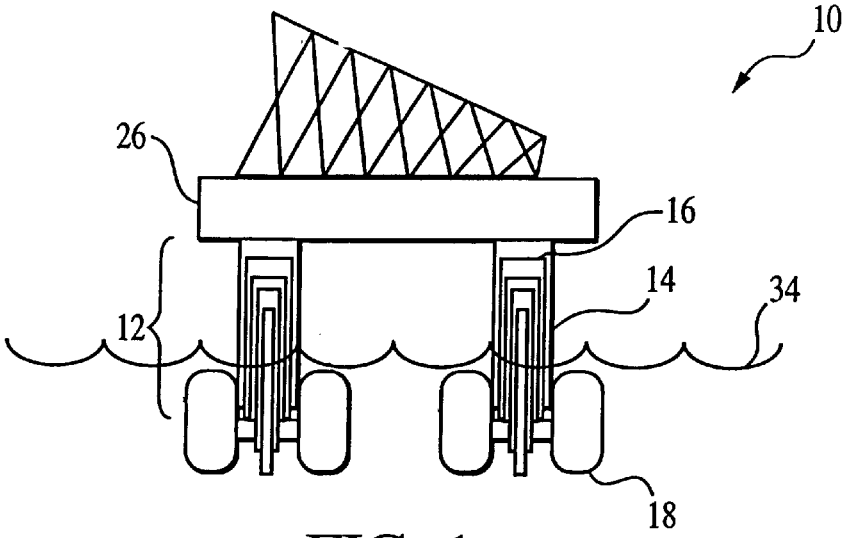
FIG. 1 is a schematic diagram illustrating an embodiment of the present invention in a pre-deployment configuration.

A first embodiment of the present invention, illustrated in FIG. 1 in a pre-deployment configuration, concerns a multileg structure 10 to support, for example, undersea drilling operations. The structure 10 comprises four spars 12 (only two are shown), each spar 12 including a series of five concentric, thin-walled, telescoping tubes 14. In FIG. 1, the spars 12 are shown in a pre-deployment, stowed configuration as would be used for example during transportation to a deployment site. The exact number of tubes 14, their size and their length is mission dependent as the structure 10 can easily be scaled for different operating parameters. For lake and low sea-state applications, the length and/or the number of tubes 14 can be small. The deployed length of the tubes 14 is dictated by the stability requirements of the application, and one skilled in the art can select the proper size and number of telescoping tubes 14. Material selection is also up to an individual designer. Plastic, steel, phenolic or even resin-coated paper, among many other materials, could be used in the construction of the spars 12.

The nested tubes 14 may be held together during storage and deployment by a simple locking mechanism (not shown in FIG. 1) that one skilled in the art can construct. The locking mechanism could be remotely activated, water-activated or time release activated to release the tubes 14 when needed during deployment. The tubes 14 are preferably sized so that they slide in and out freely. A series of joints 16 at the ends of the tubes 14 prevent the tubes from separating from each other when the spars 12 are extended. The joints 16 may be constructed such that the tubes 14 lock into place after deployment. For larger structures 10, such as oil production platforms, the nested tubes 14 could be stored inside or on the platform/hull 26 so that the structure 10 could be more easily towed by a ship. During deployment, the tubes 14 would drop through the platform/hull 26 into their extended position.

Although round tubing is an economical design selection, a variety of different designs could be used; for example, round tubes with weight reducing holes, elliptic or square tube stock. For applications where orientation of the telescoping tubes 14 is important, these materials would have some advantages over round stock. Also, a compound structure similar to a three-legged truss structure used in radio antenna towers could be used where higher strength is needed in the design. A telescoping 3-legged buoy structure could be an excellent design for high sea state operation. However, whichever type of telescoping structure is used, the concepts of the present invention remain the same.

Figure 2:
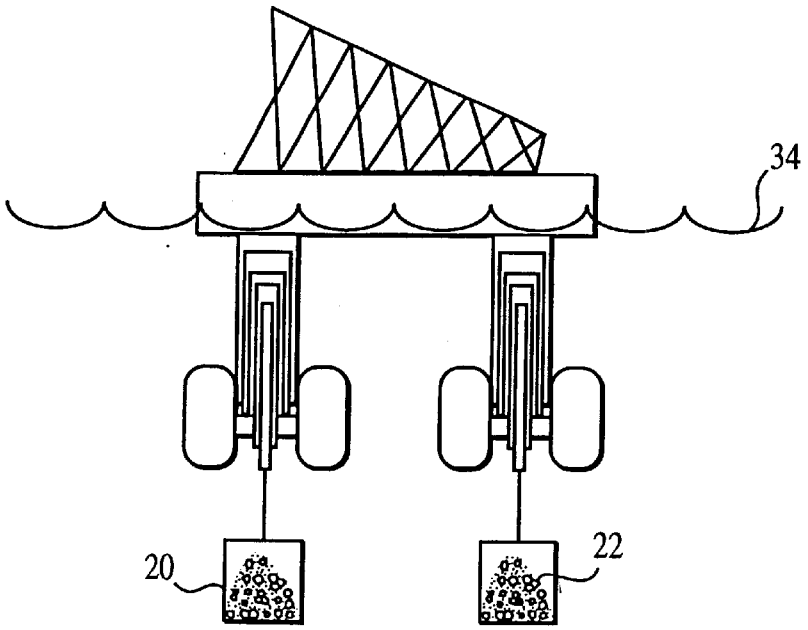
FIG. 2 is a schematic diagram illustrating an embodiment of the present invention including ballast in a pre-deployment configuration.

FIG. 2 shows the same embodiment as FIG. 1, however ballast-filled damping chambers 20 are added to the spars 12. The weight of the ballast 22 lowers the structure 10 in the water in preparation for deployment of the telescoping spars 12.

Figure 3:
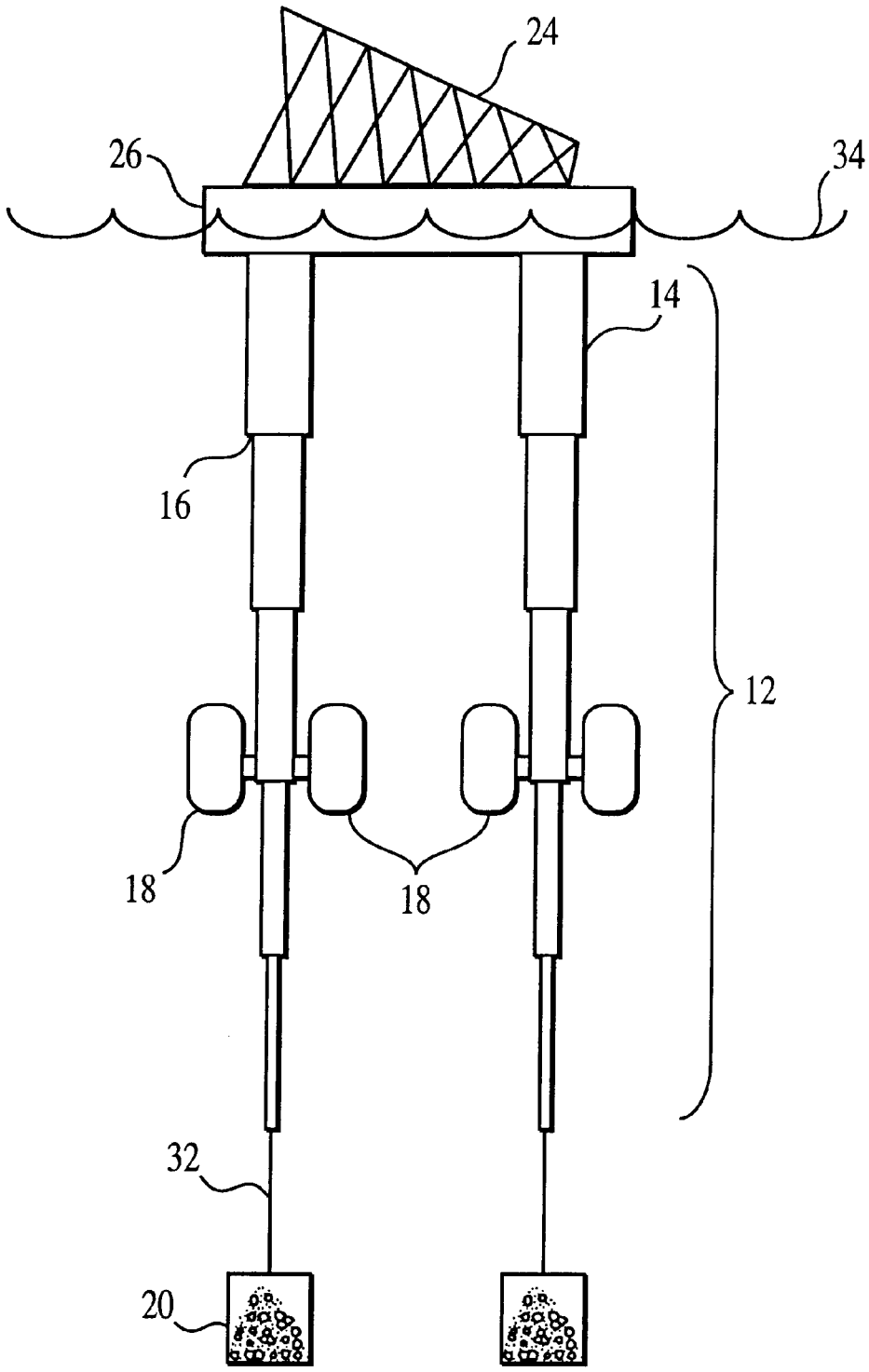
FIG. 3 is a schematic diagram illustrating an embodiment of the present invention including ballast in a partially deployed configuration.

FIG. 3 shows the same embodiment as illustrated in FIGS. 1 & 2; however the structure 10 is now partially deployed. After the pre-deployment locking mechanism is released, the force of gravity on the ballast 22 causes the spars 12 to become fully extended. Buoyancy chambers 18 are attached to the third telescoping tubes 14 and, whereas the chambers 18 were previously near the waterline 34, they are now shown pulled deeper beneath the waterline 34. In some embodiments, the chambers 18 buoyancy would be prohibitively large for the ballast 22 to effectively extend the spar 12 via gravity alone. In those cases, the chambers 18 can also be flooded to assist in extending the spars 12 to their operational length. The size of the buoyancy chambers 18 will depend on the weight of the structure 10 and its mission payload, e.g., from heavy and large oil rigs to lightweight and compact instrumentation, antennas, etc. The tube 14 to which the buoyancy chamber is attached is dependent on the sea-state. Again, one skilled in the art of spar buoy design can select the proper size for the buoyancy chambers 18. In the present embodiment, placing the buoyancy chambers 18 on the third tube 14 is designed to place the chambers 18 at a relatively deep depth, out of the influence of most wave action. The buoyancy chambers 18 are attached to a tube 14 so that the smaller tubes 14 beneath the chamber 18 are not obstructed.

Figure 4:
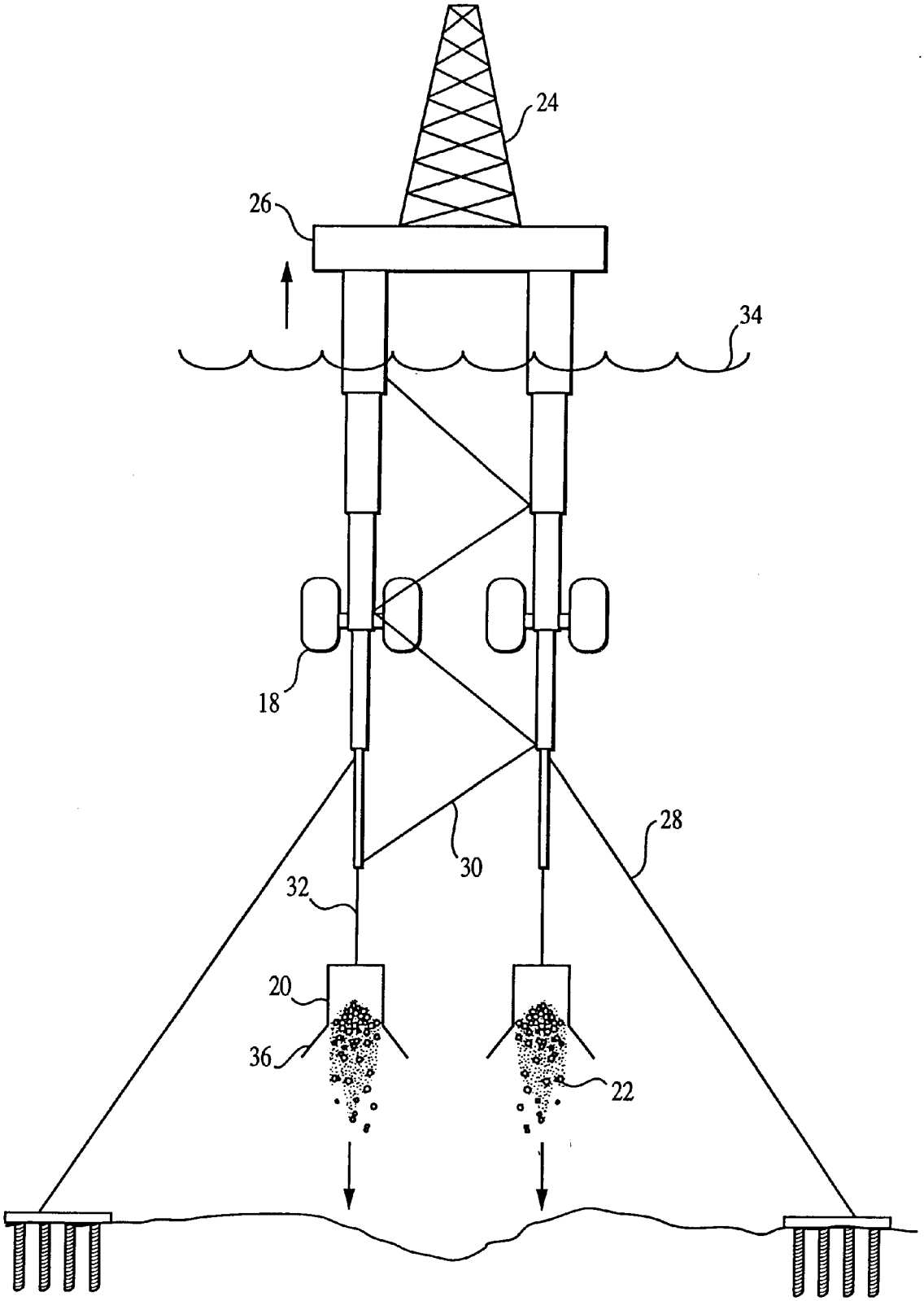
FIG. 4 is a schematic diagram illustrating an embodiment of the present invention in a fully deployed configuration after the ballast is jettisoned.

FIG. 4 shows the same embodiment as illustrated in FIGS. 1–3; however the structure 10 is now filly deployed. After the spars 12 are fully extended and locked into place, the ballast 22 is jettisoned from the damping chamber 20. For the case where the buoyancy chambers are buoyant, the mass reduction of the damping chamber 20 will cause the entire structure 10 to rise to its operational height relative to the waterline 34. For the case where the buoyancy chambers 18 are not buoyant, after the spars 12 are fully extended and locked into place, air is pumped into the buoyancy chambers 18 and causes the entire structure 10 to rise to its operational height relative to the waterline 34.

Operation of the embodiment shown in FIGS. 1–4 is summarized as follows:

1. The compact structure 10 is transported (e.g., shipped, towed, flown, etc.) to a deployment site. (FIG. 1.)
2. At the deployment site, a damping chamber 20 including ballast 22 is connected to the compacted spars 12 of the structure 10. Alternatively, or in addition to the ballast 22, the buoyancy chambers 18 are flooded. (FIG. 2.)
3. The spars 12 are deployed to their full length using gravity as the activation mechanism.
4. The fully deployed spars 12 are locked into place. (FIG. 3.)
5. The buoyancy chambers 18, attached to the spars 12, are filled with air and the expendable deployment ballast 22 is jettisoned from the damping chambers 20. The structure 10 then rises to its operational height relative to the sea surface. (FIG. 4.)
6. If necessary, mooring lines 28 are attached to the structure 10 and any work rigs 24 or instrumentation are placed on or assembled on the platform/hull 26.
7. Recovery reverses the deployment procedure; however, secondary cabling (not shown) running through the spars 12, or other mechanisms, may be used to retract the spars 12 to their stowed configuration.

The structure 10 is therefore both easy to deploy and recover and, primarily because of the reduced structural requirements of deployment and recovery, is relatively inexpensive to construct. These two features make the present invention useful and economical in numerous applications such as: small, less expensive oil exploration/production platforms; relatively small and cost-effective at-sea windmill/wave energy production platforms; and cost-effective oceanographic platforms for the detailed study of the environment.

Note that FIGS. 1–4 illustrate only a single embodiment of the present invention and that those skilled in the art will readily appreciate other embodiments within the scope of the present invention. For example, small oceanographic platforms may use only a single telescoping spar according to the present invention, whereas larger oil platforms could employ many more spars than are illustrated in FIGS. 1–4. The following additional details of the present embodiment should therefore be understood to apply equally well to numerous other embodiments.

Referring again to FIGS. 1–4, the buoyancy chambers 18 can be fabricated in a variety of ways. One construction technique would fabricate the chambers 18 of syntactic foam, making a fixed chamber. As suggested above, if one required variable buoyancy chambers 18, the chambers 18 could be hollow (possibly with a flexible bladder) and air could be pumped into and out of the chambers 18 to change their buoyancy. The need for variable buoyancy chambers 18 is application dependent. Typically, one would use variable buoyancy chambers 18 in cases where the amount of ballast 22 to pull the buoyancy chamber 18 and telescoping spars 12 underwater to the proper deployment depth is prohibitively large.

The shape of the buoyancy chambers 18 is an important design parameter. A high cross sectional area chamber close to the water surface could allow wave action to adversely affect the structure 10 stability. As known to those skilled in the art, an engineering study could be performed to optimize the depth of the buoyancy chambers 18 and the shape and size of the chambers 18. Also, adding additional telescoping tubes 14 to the spars 12 and placing the chambers 18 deeper and farther from the wave effects could be simpler than designing a complex buoyancy chamber 18.

Stability of the structure 10 can also be improved by adding stabilization cables 30 (as shown in FIG. 4) between the spars 12.

If the platform/hull 26 needs to remain close to a constant level above the waterline 34, then the spars should have buoyancy at the waterline 34. Since the telescoping tubes 14 may be negatively buoyant, a "trim" floatation section (not shown in the Figures) should be added to the tubes 14 near the waterline 34. The trim floatation can be as simple as a closed-cell foam collar around the tubes 14 extending a length above and below the waterline 34. The amount of buoyancy the collar provides per its submerged length is selected to give the structure 10 its required "spring constant" for stable operation in a selected sea state. This spring constant is one element that determines the structure's resonance frequency and is selected to be much lower than the lowest expected wave frequency.

The platform/hull 26 may also act as a reserve buoyancy chamber at the top of the spars 12 and help ensure that the work rig 24 remains above water. The floatation provided by the platform/hull 26 is sized in at least one embodiment to support generally two to three times the deployment ballast 22. In some applications, the reserve buoyancy of the floatation is an important component of the structure 10 and is used in the deployment sequence.

The damping chamber 20 is attached to or near the bottom tube 14 via a rope, chain or other type of connection device 32. In addition to storing ballast 22, the chamber's function is to add mass to the structure 10 by entraining water when the chamber 20 is in the water without adding weight to the structure 10 when the chamber 20 is out of the water. The added mass of the entrained water effectively lowers the structure's resonance frequency and thus makes the structure more stable in high sea-states. A single compartment in the chamber 20 can serve the function of storing both ballast 22 and entrained water by simply providing porous walls to the chamber that prevent the ballast from falling out but still allow water to enter. Also, the chamber 20 can be used to store fixed ballast (not shown in the Figures) that would not be released during deployment of the structure 10 but would remain enclosed in the damping chamber 20 as additional stabilizing mass. One skilled in the art can readily select the proper size and shape of the damping chamber(s) 20.

As discussed above, the damping chamber 20 includes a release mechanism (not shown in the Figures) that jettisons the expendable deployment ballast 22 at the proper time in the deployment sequence. The release mechanism can be an automatic, time-delayed, water-activated mechanism that opens a trap door 36 or a remote controlled mechanism under the control of the deployment operator. When the trap door 36 is opened, the deployment ballast 22 is released. The deployment ballast 22 can be any number of different materials: sand, rocks, or other environment-friendly material.

Much smaller scale applications of the present invention are also possible. For example, a second embodiment of the present invention is a three-leg 12 weather system that can also be described in reference to FIGS. 1–4 (the third spar however is not shown). Weather sensors (e.g., anemometer, wind vane, thermometer, etc.) would be located on the platform/hull 26, and a data acquisition system (DAS) could be located in a waterproof housing on the platform/hull 26. A battery pack could be located at the bottom of one spar 12 so that it serves as ballast and contributes to the system's stability without additional nonfunctional mass. A power cable could be designed to extend the length of the telescoped spars 12 to the battery pack.

If a mission required recovery of the weather system, the system would also include a recovery winch or similar mechanism to draw the telescoped spars 12 back into their retracted position. One possible design again uses gravity to pull the extended spars 12 back together. A second ballast material could be deployed from the recovery vessel where the ballast is connected to lines that would pull the telescoping spars 12, after the locking mechanisms are disengaged, back into their retracted position.

Other variations to small-scale embodiments of the present invention include the use of deflatable or expendable reserve buoyancy at the platform/hull 26. As described above, the spar structure 10 is initially ballasted to place the platform/hull 26 at its operational height. The addition of the expendable ballast 22 sinks the structure 10 to the waterline of the reserve buoyancy provided by the platform/hull 26. The reserve buoyancy of the platform/hull 26 supports the top of the structure 10 while the weight of the ballast 22 extends the spars 12. After the spars 12 extend to their deployed position and are locked into place, the expendable ballast 22 is jettisoned. Without the expendable ballast 22, the structure 10 and payload on the platform/hull 26 rises to its operational height relative to the waterline 34. However, in some cases the deployed platform/hull 26 will not be able to support the material (e.g., inflatable device, floatation material, etc.) required to provide the necessary pre-deployment reserve buoyancy. For example, some systems may require a large amount of expendable ballast, and would therefore require significant reserve buoyancy material at the platform/hull 26 to keep a payload dry. In such cases the reserve buoyancy material could be expendable or it could comprise an inflatable device such as an air-filled tube/collar. After the structure 10 is deployed, the reserve buoyancy material could be deflated or released from the platform/hull 26 so that it drops to the waterline so that it rides up and down the spar(s) 12 along with any wave action. A scientific meteorological package is an example of a payload that could require the reserve buoyancy material to be removed after deployment. The relatively large mechanical structure of the reserve buoyancy material could distort airflow around the wind instrumentation of the meteorological package and compromise the wind measurements.

Figure 5A:
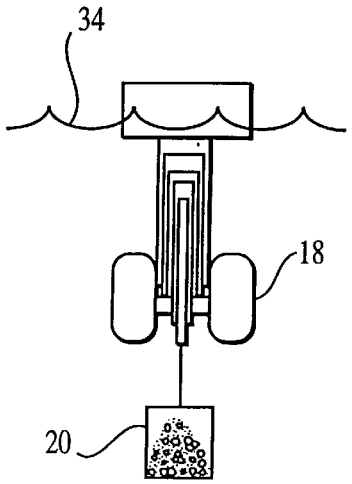
FIGS. 5A–5C are schematic diagrams of an embodiment of the present invention at various stages of deployment.
Figure 5B:
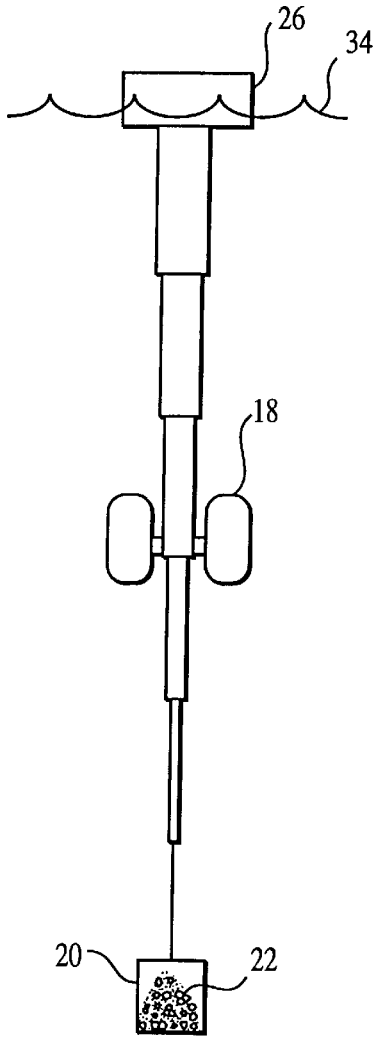
Figure 5C:
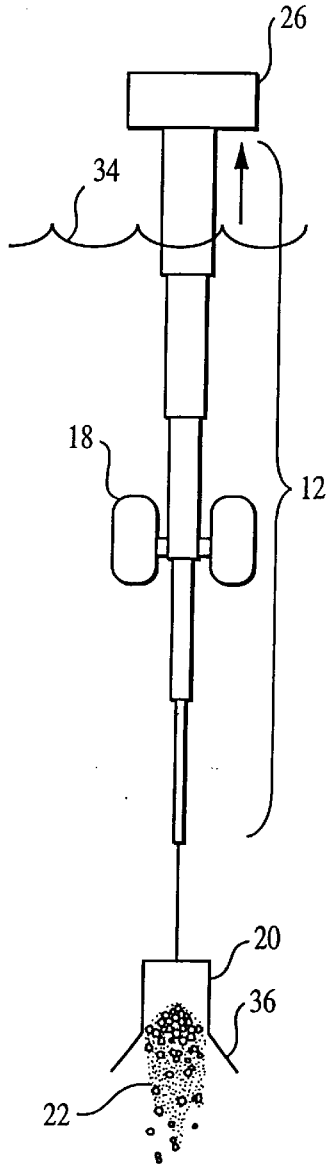

Referring to FIGS. 5A–5C, following is a more detailed description of a ship-based deployment and recovery of an embodiment of the present invention. In this embodiment it is again assumed that the structure 10 is a relatively small, single spar 12 system, such as the weather system described above, that can be deployed from a suitable sized ship or aircraft. It is also assumed that the buoyancy of the structure is fixed so that the buoyancy chamber 18 does not need to be adjusted during deployment and recovery. However, one skilled in the art could modify the deployment and recovery procedure described here to account for a variable buoyancy system. (The shipboard activities are not illustrated in FIGS. 5A–5C.)

An example of a deployment procedure is as follows:

1. The structure 10 is disengaged from a deck-mounted cradle on a ship and connected to a deploying crane or U-frame.
2. The structure 10 is lifted vertically and placed just above the water while the ship is moving slowly forward.
3. The damping chamber 20 is then pushed off the ship and into the water at the same time that the structure 10 is released from the crane or U-frame via a quick disconnect or similar device.
4. The structure 10 then sinks up to the reserve buoyancy platform/hull 26. (FIG. 5A.)
5. A water-activated release device (or remote release device) on a release drum spool allows the ballast 22 to extend the nested tubes 14 to their full length and the telescoping spar joints 16 to lock into position. (FIG. 5B.)
6. A short time later the water-activated trap door 36 on the damping chamber 18 releases the expendable deployment ballast 22.
7. The structure 10, more buoyant after the release of the expendable ballast 22, then rises up to its operating height. (FIG. 5C.)

Advantages of the deployment operation shown above include the fact that the ship simply drops the structure 10 overboard and moves away—the deployment is automatic. Further, the automatic deployment mechanism is simple and passive; it relies on only the water activated release and gravity for its power. Assuming proper design and clearances, the telescoping tubes 14 simply fall into place. Finally, if some mechanism does manage to jam, the action of the structure 10 in the waves will more than likely "wiggle" the jammed parts free. The higher the sea state, the more likely the structure 10 will properly deploy. Such a feature is superior to conventional spar designs that are less likely to deploy in high sea states.

An example of a recovery procedure is as follows:

1. The ship approaches the structure 10 and activates the recovery procedure with a simple remote control device.
2. A winch motor (in the mission package) is activated by the remote control and pulls the ballast 22 and the lower tube section 14 up into the first tube 14 at the waterline 34.
3. The ship uses a grappling hook to recover a lifting line attached to a small float. The other end of the lifting line is attached to the lift point on the top of the structure 10.
4. The ship then proceeds to haul in the structure 10 like any other wave riding buoy.

Other options that could be included in the recovery procedure include jettisoning the damping chamber 20. A lower capacity winch could be used to pull in the extended tubes 14 if the ballast weight of the chamber 20 were not present. The damping chamber 20 could also be recovered with a separate tag line and pulled aboard the ship. Also, if the seas were too high for an easy recovery, the structure 10 could have an optional, built-in release mechanism (e.g., pull pin) that would drop all parts of the structure 10 except the platform/hull 26 that presumably supports an expensive payload that is worth the effort to retrieve.

Finally, if the structure 10 were designed as an expendable system, then a recovery system would not be required. In that case, the joints 16 could be made very simply by using a very long tamper fit. The lower circumference of the outside tubes 14 could be flared in and the upper circumference of the inside tubes 14 could be flared out. The speed damper mechanism could be reduced in size or eliminated altogether and the joints 16 allowed to jam into place. As an expendable system, the mechanical structure could also be of a biodegradable configuration such as resin/wax coated paper. The resin/wax could be designed with a finite water proofing life and after it degrades the paper structure of the system would dissolve in the water.

The above therefore discloses a telescoping spar platform apparatus and method for deploying, using, and recovering the same. Alterations, modifications, and improvements concerning various other applications will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

I claim:

1. A method of deploying a telescoping spar, comprising the steps of:

placing a telescoping spar having first and second ends in water;

employing a damping chamber containing deployment ballast to pull said first end of said spar under the water, said damping chamber further causing said spar to telescope, increasing the distance between said first and second ends of said spar;

activating a release mechanism for jettisoning said deployment ballast from said damping chamber after said spar achieves a substantially vertical orientation;

employing a buoyancy chamber attached to said spar between said first and second ends of said spar to lift said spar to an operational height; and entraining water in said damping chamber to damp wave-induced forces on said spar.

2. The method of deploying a telescoping spar as recited in claim 1, wherein said step of activating a release mechanism is automatically triggered at a set interval after said spar is placed in water.

3. The method of deploying a telescoping spar as recited in claim 1, further comprising the step of flooding said buoyancy chamber with water to assist in increasing the distance between said first and second ends of said spar.

4. The method of deploying a telescoping spar as recited in claim 3, further comprising the step of pumping air into said buoyancy chamber after said spar is fully extended.

5. The method of deploying a telescoping spar as recited in claim 1, wherein said deployment ballast comprises an environment-friendly material.

* * * * *